US010709303B2

(12) United States Patent
Clark

(10) Patent No.: US 10,709,303 B2
(45) Date of Patent: Jul. 14, 2020

(54) TOILET SEAT LIFTING ASSEMBLY

(71) Applicant: Arthur Clark, Detroit, MI (US)

(72) Inventor: Arthur Clark, Detroit, MI (US)

( * ) Notice: Subject to any disclaimer, the term of this patent is extended or adjusted under 35 U.S.C. 154(b) by 5 days.

(21) Appl. No.: 16/134,661

(22) Filed: Sep. 18, 2018

(65) Prior Publication Data

US 2020/0085264 A1 Mar. 19, 2020

(51) Int. Cl.
*A47K 13/10* (2006.01)

(52) U.S. Cl.
CPC ..... *A47K 13/10* (2013.01)

(58) Field of Classification Search
CPC ..... A47K 13/10; A47K 13/105; B65F 1/1623; B65F 1/163; E03D 5/04; A47C 3/30
USPC ..... 4/246.1, 246.3–246.5; 220/262–264
See application file for complete search history.

(56) References Cited

U.S. PATENT DOCUMENTS 3,528,075 A * 9/1970 Leon ..... A47K 13/10 4/246.5
5,075,906 A * 12/1991 Robbins ..... A47K 13/10 4/246.5
5,327,589 A * 7/1994 Rice ..... A47K 13/10 4/246.2
5,448,782 A * 9/1995 Ratajac ..... A47K 13/10 4/246.5
5,488,744 A * 2/1996 Paananen ..... A47K 13/10 4/246.2
5,594,958 A 1/1997 Nguyen
5,742,949 A * 4/1998 Goldi ..... A47K 13/10 4/246.2
5,875,498 A 3/1999 Joseph
6,112,335 A * 9/2000 Gaston ..... A47K 13/10 4/246.1
6,449,783 B1 * 9/2002 Moser ..... A47K 13/10 4/254
D560,274 S 1/2008 Hoang
7,367,066 B1 5/2008 Reid
8,020,221 B2 * 9/2011 Borochov ..... A47K 13/10 220/262
8,230,529 B1 * 7/2012 Reid ..... A47K 13/10 4/246.3
8,566,970 B2 10/2013 Collignon
9,326,649 B1 5/2016 Ophori
(Continued)

FOREIGN PATENT DOCUMENTS

WO WO8804534 * 6/1988 ..... A47K 13/10

*Primary Examiner* — David P Angwin
*Assistant Examiner* — Nicholas A Ros

(57) ABSTRACT

A toilet seat lifting assembly for lifting a toilet seat includes a toilet that has a toilet seat which is hingedly coupled thereto for sitting on. a cup is operationally coupled to the toilet seat. A hydraulic rod is included that has a rounded end defining a ball, and the ball is rotatably retained in the cup such that the hydraulic rod is pivotable in the cup. A pedal housing is positionable on a floor adjacent to the toilet and the hydraulic rod slidably extends into the pedal housing. A first lever is pivotally coupled to the pedal housing and the first lever actuates the hydraulic rod to extend upwardly when the first lever is manipulated. A second lever is pivotally coupled to the first lever and a pedal is pivotally coupled to the pedal housing. The pedal is pivotally coupled to the second lever and the second lever manipulates the first lever when the pedal is stepped on for lifting the toilet seat.

5 Claims, 6 Drawing Sheets

(56) References Cited

U.S. PATENT DOCUMENTS

2002/0032924 A1* 3/2002 Shimada ..... A47K 13/10
4/246.1

* cited by examiner

TOILET SEAT LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

The disclosure relates to a lifting device for lifting a toilet seat without touching the toilet seat.

(2) Description of Related Art including information disclosed under 37 CFR 1.97 and 1.98.

The prior art relates to lifting devices.

BRIEF SUMMARY OF THE INVENTION

An embodiment of the disclosure meets the needs presented above by generally comprising a toilet that has a toilet seat which is hingedly coupled thereto for sitting on. a cup is operationally coupled to the toilet seat. A hydraulic rod is included that has a rounded end defining a ball, and the ball is rotatably retained in the cup such that the hydraulic rod is pivotable in the cup. A pedal housing is positionable on a floor adjacent to the toilet and the hydraulic rod slidably extends into the pedal housing. A first lever is pivotally coupled to the pedal housing and the first lever actuates the hydraulic rod to extend upwardly when the first lever is manipulated. A second lever is pivotally coupled to the first lever and a pedal is pivotally coupled to the pedal housing. The pedal is pivotally coupled to the second lever and the second lever manipulates the first lever when the pedal is stepped on for lifting the toilet seat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
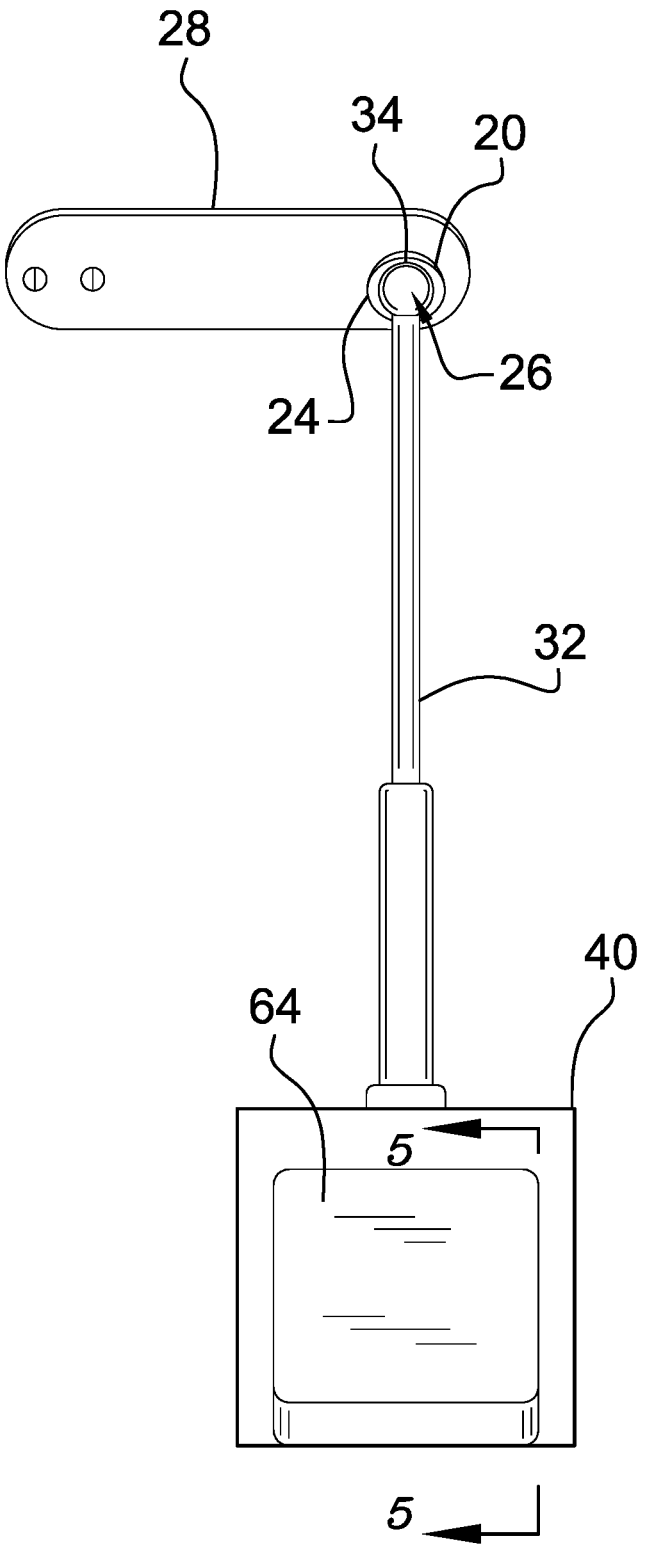
FIG. 1 is a front view of a toilet seat lifting assembly according to an embodiment of the disclosure.
Figure 2:
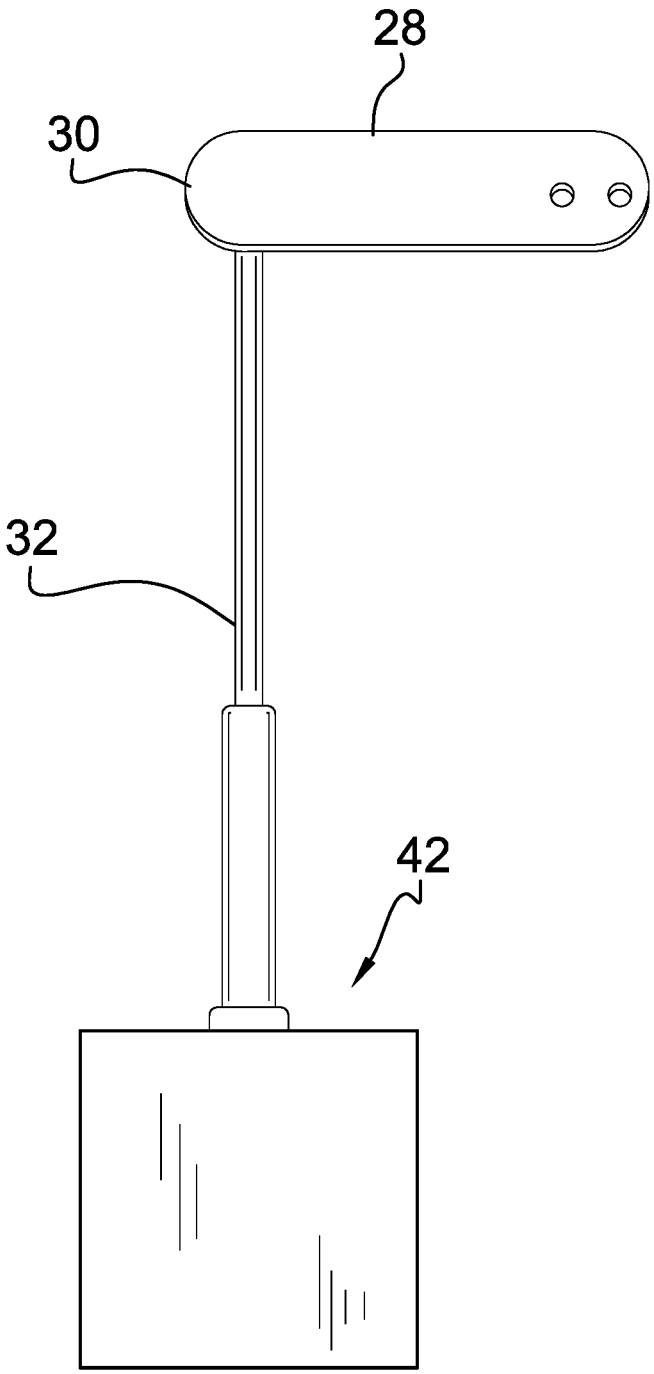
FIG. 2 is a back view of an embodiment of the disclosure.
Figure 3:
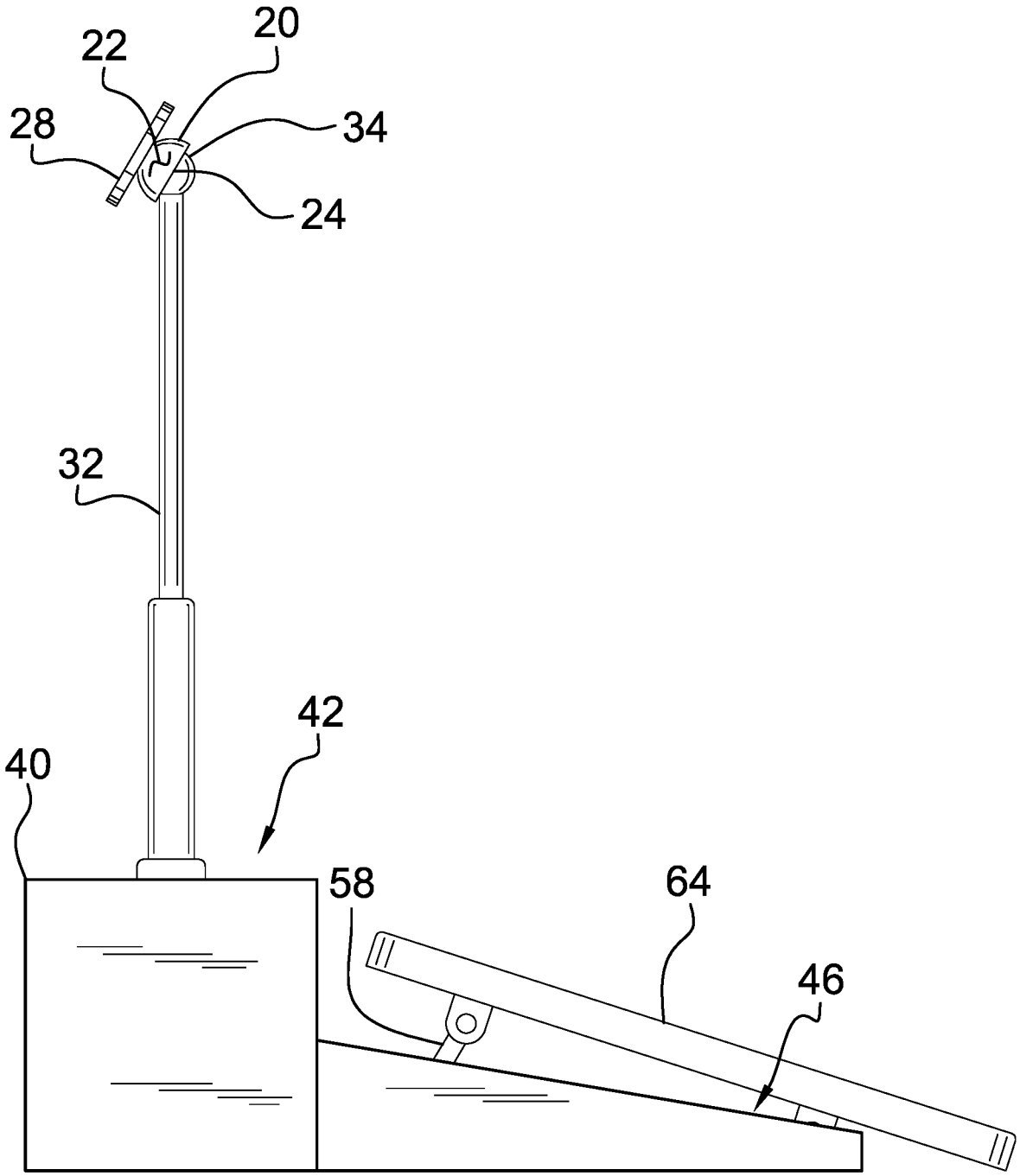
FIG. 3 is a left side view of an embodiment of the disclosure.
Figure 4:
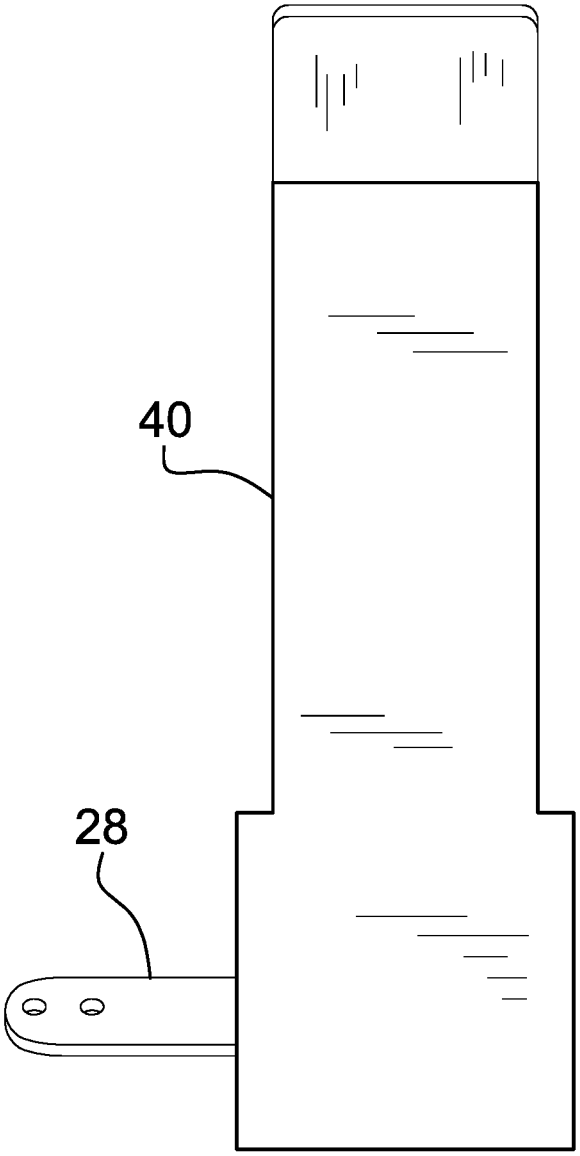
FIG. 4 is a bottom view of an embodiment of the disclosure.
Figure 5:
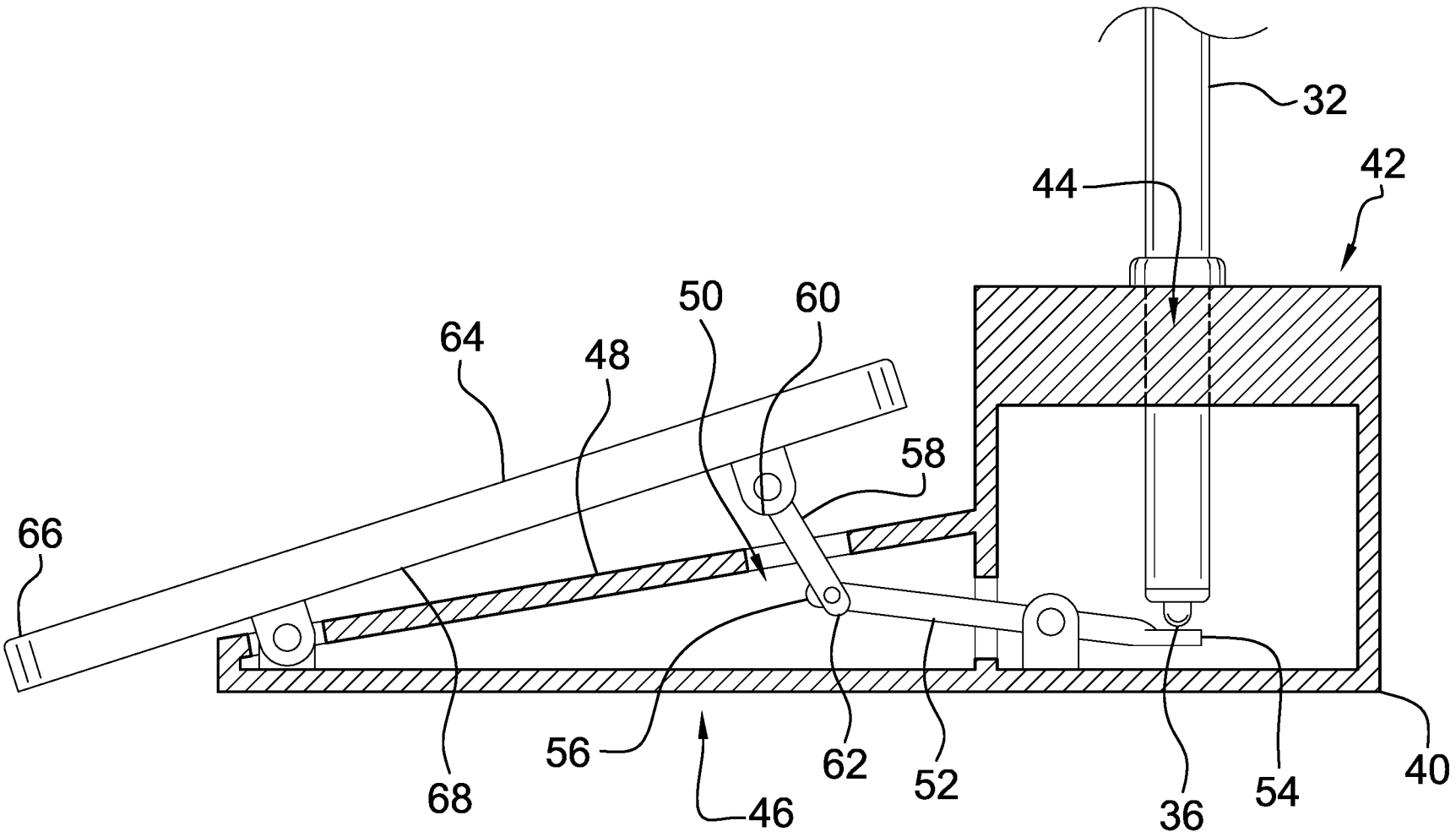
FIG. 5 is a cross sectional view taken along line 5-5 of FIG. 1 of an embodiment of the disclosure.
Figure 6:
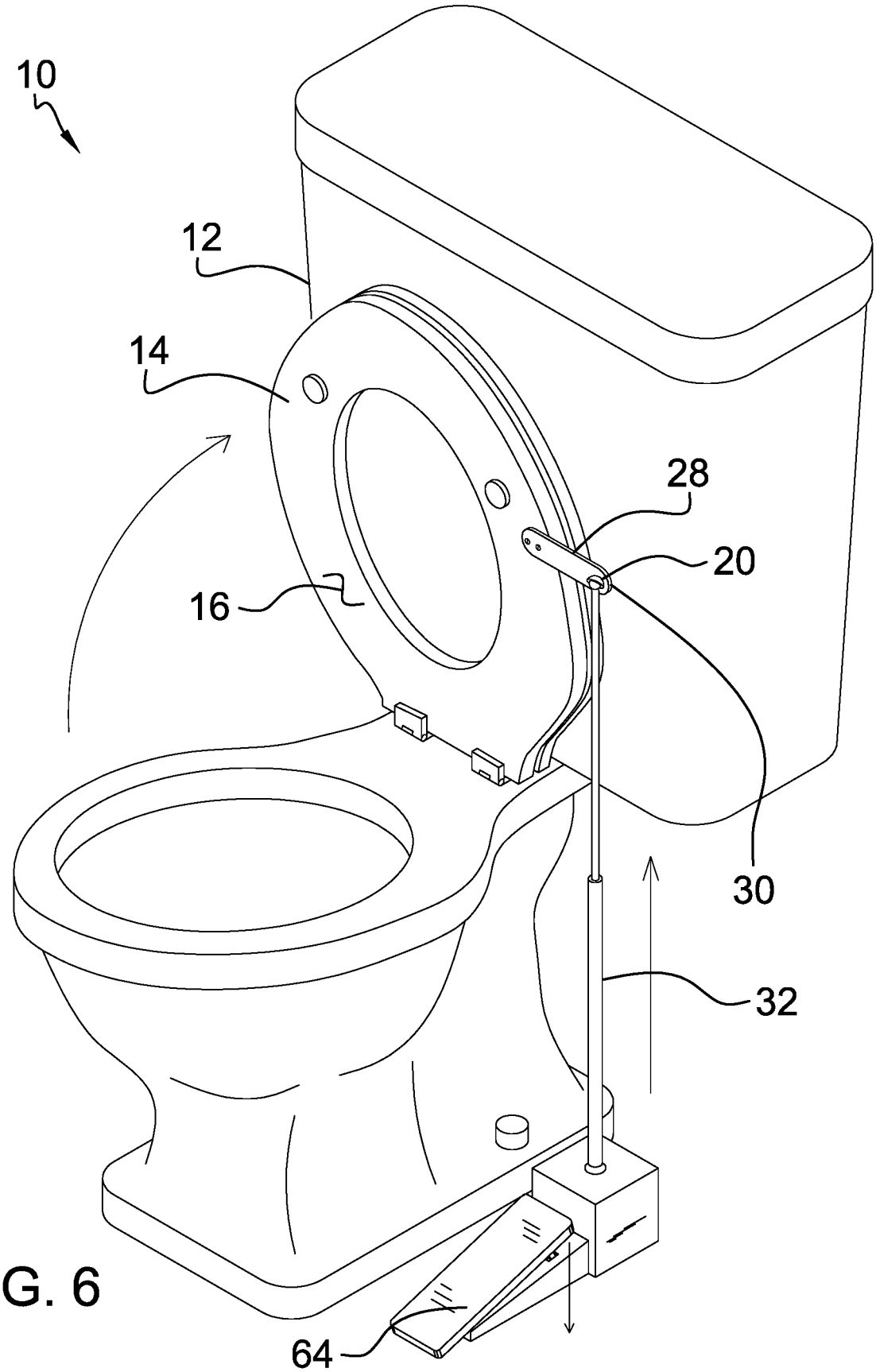
FIG. 6 is a perspective in-use view of an embodiment of the disclosure.

With reference now to the drawings, and in particular to FIGS. 1 through 6 thereof, a new lifting device embodying the principles and concepts of an embodiment of the disclosure and generally designated by the reference numeral 10 will be described.

As best illustrated in FIGS. 1 through 6, the toilet seat lifting assembly 10 generally comprises a toilet 12 that has a toilet seat 14 hingedly coupled thereto for sitting on and the toilet seat 14 has a bottom surface 16. The toilet 12 may be a plumbed toilet 12 of any conventional shape and design. A cup 20 is operationally coupled to the toilet seat 14 and the cup 20 has an outer surface 22 and a bottom edge 24 defining an opening 26 into the cup 20. A bracket 28 is coupled to and extends laterally away from the bottom surface 16 of the toilet seat 14 and the bracket 28 has a distal end 30 with respect to the toilet seat 14. The outer surface 22 of the cup 20 is coupled to the bracket 28 having the opening 26 in the cup 20 being directed downwardly when the toilet seat 14 is lowered. Moreover, the cup 20 is aligned with the distal end 30 of the bracket 28.

A hydraulic rod 32 is included that has a rounded end 34 defining a ball 36, and the ball 36 is rotatably retained in the cup 20 such that the hydraulic rod 32 is pivotable in the cup 20. The hydraulic rod 32 has a distal end 38 with respect to the rounded end 34 and the hydraulic rod 32 is elongated to a sufficient length to extend substantially between the toilet seat 14 and the floor when the toilet seat 14 is lifted. The hydraulic rod 32 may include a telescopic hydraulic piston of any conventional design.

A pedal housing 40 is provided, the pedal housing 40 is positionable on a floor adjacent to the toilet 12 and the hydraulic rod 32 slidably extends into the pedal housing 40. The pedal housing 40 has a first portion 42 which has a first aperture 44 extending therethrough for insertably receiving the hydraulic rod 32 having the distal end 38 of the hydraulic rod 32 being positioned within the first portion 42. The pedal housing 40 has a second portion 46 sloping away from the first portion 42, the second portion 46 has an upper wall 48 and the upper wall 48 has a second aperture 50 extending into an interior of the second portion 46.

A first lever 52 is pivotally coupled to the pedal housing 40 and the first lever 52 has a first end 54 and a second end 56. The first lever 52 extends between the first 42 and second 46 portions of the pedal housing 40 having the first end 54 positioned in the first portion 42 and having the second end 56 positioned in the second portion 46. The first end 54 engages the distal end 38 of the hydraulic rod 32 and the first lever 52 actuates the hydraulic rod 32 upwardly when the second end 56 of the first lever 52 is urged downwardly. A ball may be coupled to the distal end 38 of the hydraulic rod 32 and the hydraulic rod 32 may be flattened adjacent to the first end 54 to engage the ball on the distal end 38 of the hydraulic rod 32.

A second lever 58 is pivotally coupled to the first lever 52 and the second lever 58 has a primary end 60 and a secondary end 62. The secondary end 62 is pivotally coupled to the second end 56 of the first hydraulic rod 32. Moreover, the second lever 58 extends upwardly through the second aperture 50 in the second portion 46 of the pedal housing 40 having the secondary end 62 being exposed. A pedal 64 is pivotally coupled to the pedal housing 40 and the pedal 64 is pivotally coupled to the second lever 58. The second lever 58 urges the second end 56 of the first lever 52 downwardly when the pedal 64 is stepped on for lifting the toilet seat 14. The pedal 64 has a first end 66 that is pivotally coupled to the upper wall 48 of the second portion 46 of the pedal housing 40. The secondary end 62 of the second lever 58 pivotally engages a bottom surface 68 of the pedal 64.

In use, the bracket 28 is coupled to the bottom surface 16 of the toilet seat 14 with screws or other fasteners. The pedal housing 40 is positioned on the floor next to the toilet 12. The pedal 64 is stepped on by a male user when the male user approaches the toilet 12 to urinate. Thus, the hydraulic rod 32 extends thereby raising the toilet seat 14. In this way the male can urinate in the toilet 12 without touching the toilet seat 14, and the toilet seat 14 is protected from being sprayed with urine. The hydraulic rod 32 retracts when the pedal 64 is no longer stepped on.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat lifting assembly being configured to be stepped on for lifting a toilet seat, the assembly comprising:

a toilet having a toilet seat being hingedly coupled thereto for sitting on, the toilet seat having a bottom surface;

a cup being operationally coupled to the toilet seat, the cup having an outer surface and a bottom edge defining an opening into the cup;

a hydraulic rod having a rounded end defining a ball, the ball being rotatably retained in the cup such that the hydraulic rod is pivotable in the cup, the hydraulic rod having a distal end with respect to the rounded end;

a bracket being coupled to and extending laterally away from the bottom surface of the toilet seat, the bracket having a distal end with respect to the toilet seat, the outer surface of the cup being coupled to the bracket having the opening in the cup being directed downwardly when the toilet seat is lowered;

a pedal housing being positionable on a floor adjacent to the toilet, the hydraulic rod slidably extending into the pedal housing through a circular opening complementary in shape to a diameter of the hydraulic rod, the pedal housing having a first portion having a first aperture extending therethrough for insertably receiving the hydraulic rod having the distal end of the hydraulic rod being positioned within the first portion, the pedal housing having a second portion sloping away from the first portion, the second portion having an upper wall, the upper wall having a second aperture extending into an interior of the second portion;

a first lever being pivotally coupled to the pedal housing, the first lever acuating the hydraulic rod to extend upwardly when the first lever is manipulated;

a second lever being pivotally coupled to the first lever; and a pedal being pivotally coupled to the pedal housing, the pedal being pivotally coupled to the second lever, the second lever manipulating the first lever when the pedal is stepped on for lifting the toilet seat.

2. The assembly according to claim 1, wherein the first lever has a first end and a second end, the first lever extending between the first and second portions of the pedal housing having the first end being positioned in the first portion and having the second end being positioned in the second portion, the first end engaging the distal end of the hydraulic rod.

3. The assembly according to claim 2, wherein the second lever has a primary end and a secondary end, the secondary end being pivotally coupled to the second end of the first lever, the second lever extending upwardly through the second aperture in the second portion of the pedal housing having the primary end being exposed.

4. The assembly according to claim 1, wherein:

the first lever has a first end;

the second lever has a primary end and a secondary end; and the pedal has a first end being pivotally coupled to the upper wall of the second portion of the pedal housing, the primary end of the second lever pivotally engaging a bottom surface of the pedal, the second lever urging the second end of the first lever downwardly when the pedal is stepped on for lifting the toilet seat.

5. A toilet seat lifting assembly being configured to be stepped on for lifting a toilet seat, the assembly comprising:

a toilet having a toilet seat being hingedly coupled thereto for sitting on, the toilet seat having a bottom surface;

a cup being operationally coupled to the toilet seat, the cup having an outer surface and a bottom edge defining an opening into the cup;

a bracket being coupled to and extending laterally away from the bottom surface of the toilet seat, the bracket having a distal end with respect to the toilet seat, the outer surface of the cup being coupled to the bracket having the opening in the cup being directed downwardly when the toilet seat is lowered;

a hydraulic rod having a rounded end defining a ball, the ball being rotatably retained in the cup such that the hydraulic rod is pivotable in the cup, the hydraulic rod having a distal end with respect to the rounded end;

a pedal housing being positionable on a floor adjacent to the toilet, the hydraulic rod slidably extending into the pedal housing through a circular opening complementary in shape to a diameter of the hydraulic rod, the pedal housing having a first portion having a first aperture extending therethrough for insertably receiving the hydraulic rod having the distal end of the hydraulic rod being positioned within the first portion, the pedal housing having a second portion sloping away from the first portion, the second portion having an upper wall, the upper wall having a second aperture extending into an interior of the second portion;

a first lever being pivotally coupled to the pedal housing, the first lever having a first end and a second end, the first lever extending between the first and second portions of the pedal housing having the first end being positioned in the first portion and having the second end being positioned in the second portion, the first end engaging the distal end of the hydraulic rod, the first lever acuating the hydraulic rod to extend upwardly when the second end of the first lever is urged downwardly;

a second lever being pivotally coupled to the first lever, the second lever having a primary end and a secondary end, the secondary end being pivotally coupled to the second end of the first lever, the second lever extending upwardly through the second aperture in the second portion of the pedal housing having the primary end being exposed; and a pedal being pivotally coupled to the pedal housing, the pedal being pivotally coupled to the second lever, the second lever urging the second end of the first lever downwardly when the pedal is stepped on for lifting the toilet seat, the pedal having a first end being pivotally coupled to the upper wall of the second portion of the pedal housing, the primary end of the second lever pivotally engaging a bottom surface of the pedal.

* * * * *